United States Patent [19]

Westerman

[11] Patent Number: 4,699,672

[45] Date of Patent: Oct. 13, 1987

[54] METHOD OF PRODUCING AL-ZN-MG MAGNETIC MEMORY DISK SUBSTRATES

[75] Inventor: Edwin J. Westerman, San Ramon, Calif.

[73] Assignee: Kaiser Aluminum & Chemical Corporation, Oakland, Calif.

[21] Appl. No.: 856,245

[22] Filed: Apr. 28, 1986

[51] Int. Cl.[4] ..... C22F 1/04

[52] U.S. Cl. ..... 148/12.7 A; 148/11.5 A; 148/159; 420/541

[58] Field of Search ..... 148/11.5 A, 12.7 A, 148/159; 420/431

[56] References Cited

U.S. PATENT DOCUMENTS 3,466,156 9/1969 Peters et al. ..... 428/579
3,542,606 11/1970 Westerman et al. ..... 148/159
4,431,461 2/1984 Hoshino et al. ..... 148/11.5 A

*Primary Examiner*—Melvyn J. Andrews
*Attorney, Agent, or Firm*—Andrew E. Barlay

[57] ABSTRACT

Computer memory disk substrates which can be age hardened to a high yield strength after thermal flattening and yet are essentially free of magnesium silicide constituents detrimental to surface smoothness are prepared by replacing a portion of the magnesium usually includes in high amounts as an alloying element with zinc.

12 Claims, No Drawings

METHOD OF PRODUCING AL-ZN-MG MAGNETIC MEMORY DISK SUBSTRATES

BACKGROUND OF THE INVENTION

This invention relates to rigid disks used for memory storage in computers. In particular, this invention relates to disk substrates upon which layers of magnetizable materials are applied.

Aluminum alloys have long been used as substrate materials for rigid computer memory disks due to aluminum's light weight, high strength, wide availability, low cost and good surface finishing characterisitics. Advances in computer technology, however, have imposed more stringent requirements on these disks, particularly smaller thicknesses and greater areal density of information. To meet these needs, the smoothness of the substrate has become more critical.

Smoothness is particularly problematical in view of the need for high yield strengths. The disks must retain a high yield strength despite being subjected to annealing for thermal flattening and stress relief prior to application of the magnetizable layer. Existing aluminum disk technology achieves the high yield strength by incorporating magnesium in the alloy to a level of about 4%. Such high magnesium contents tend to combine with the silicon impurity normally present in aluminum alloys to form magnesium silicide constituents which are detrimental to the surface characteristics of the substrate.

The solution offered by the present invention relates to the use of zinc as an alloying element. Related literature on aluminum-zinc-magnesium alloys includes a disclosure by Westerman et al., U.S. Pat. No. 3,542,606 (Nov. 24, 1970), in connection with articles of heavy section prepared by processes which do not involve thermal flattening or annealing. Similar alloys are disclosed by Murmann, U.S. Pat. No. 684,707 (Oct. 15, 1901), where the purpose was to achieve alloy products free from pores; Fuller et al., U.S. Pat. No. 1,578,979 (Mar.30, 1926), where the purpose was to achieve cast alloys of superior machining properites; Brown et al., U.S. Pat. No. 3,674,448 (July 4, 1972), in connection with a composite anode material; McGinnis et al., U.S. Pat. No. 3,825,993 (July 30, 1974), in connection with clad product which retains its strength at high temperatures and even benefits from the exposure; and Peters et al., U.S. Pat. No. 3,466,156 (Sept. 9, 1969), in connection with multilayered magnetic tapes and discs.

SUMMARY OF THE INVENTION

It has now been discovered that replacement of a portion of the magnesium in the substrate alloy with zinc not only lessens the tendency to form magnesium silicide constituents giving rise to irregularities in the metallurgical structure and surface characteristics, but also attains a yield strength upon age hardening sufficient to meet the requirements of disk applications. The lower magnesium content permits greater latitude in the formation and processing of the alloy, allowing the application of metallurgical procedures to prevent the formation of or eliminate a substantial amount of magnesium silicide constituents.

DETAILED DESCRIPTION OF THE INVENTION AND PREFERRED EMBODIMENTS

The disk substrate alloy of the present invention is an aluminum-base alloy containing from about 4% to about 7%, preferably from about 4.5% to about 5.5% zinc, and from about 0.6% to about 2%, preferably from about 0.9% to about 1.4% magnesium. In further preferred embodiments, the silicon impurities in the alloy amount to less than about 0.5%, preferably from about 0.01% to about 0.2%. Other impurities or alloying elements may also be present, notably copper, preferably less than about 1%; manganese, preferably less than about 0.5%; zirconium, preferably less than about 0.2%; and iron, preferably less than about 0.1%.

The alloy is prepared in a form substantially free of magnesium silicide constituents. This may be achieved by conventional metallurgical processing techniques.

A notable example of such a technique is homogenization by heating a cast ingot of the alloy prior to any work forming. The temperature and time required for homogenization will vary according to economic considerations and the levels of the alloying components, particularly magnesium and silicon.

To dissolve magnesium silicide constituents formed during ingot casting, the homogenization temperature must be above the equilibrium $Mg_2Si$ solvus temperature. The following is a list of such temperatures, taken from *Equilibrium Diagrams of Aluminium Alloy Systems,* Publication No. 25 of the Aluminium Development Association (London), page 100, FIG. 76 (December, 1961):

Homogenization Temperatures For Al—Mg—Si Ternary Alloys

| % Mg | % Si | Temperature Required to Dissolve $Mg_2Si$ |
|---|---|---|
| 3.0 | 0.10 | 1020° F. |
| 3.0 | 0.05 | 840° F. |
| 2.0 | 0.10 | 930° F. |
| 2.0 | 0.05 | 770° F. |
| 1.5 | 0.10 | 880° F. |
| 1.5 | 0.05 | 740° F. |
| 1.0 | 0.10 | 840° F. |
| 1.0 | 0.05 | 700° F. |

These figures are derived from a graph and are thus approximations. The silicon amounts listed are within the range in which silicon normally occurs as an impurity. The time required for homgenization will generally range from about 8 to about 30 hours. As a general rule, less time is needed at higher temperatures and for this reason, higher temperatures than those in the table are generally used.

After homogenization, the ingot is hot rolled, at a temperature customarily within the range of about 825° F. (440° C.) to about 925° F. (496° C.). When this requires cooling the ingot down from a higher homogenization temperature, the cooling is done rapidly to prevent reformation and agglomeration of magnesium silicide constituents. After hot rolling, the alloy may be cold rolled to its final gauge.

The rolling and cutting of the alloy into a disk substrate configuration are done in accordance with conventional techniques. Actual conditions and degrees of reduction are varied in accordance with the type of alloy, dimensional requirements of the final product, and considerations of the effects of further processing steps in the formation of the ultimate product. In a typical application, hot rolling of the ingot will reduce its thickness to about 0.1–0.3 inch (0.25–0.76 cm), and cold rolling will further reduce the thickness to about 0.085 inch (0.22 cm).

The sheet may be subjected to an annealing treatment between the hot and cold rolling steps in order to leave a controlled amount of residual cold work in the product. This residual work is frequently desirable as a source of energy for the recrystallization which occurs during thermal flattening of the disks, described below. The residual work further serves as a means of controlling the grain size in the final product.

To achieve the flatness required of magnetic disks and to eliminate any susceptibility of the disk to become deformed due to residual stress patterns, the disk is subjected to a thermal flattening treatment. This is a heat treatment within the annealing range and is done either to a partial or full anneal. The termperature for this treatment is preferably from about 550° F. (288° C.) to about 900° F. (482° C.), with the range of about 650° F. (343° C.) to about 800° F. (427° C.) particularly preferred. This thermal treatment, when applied as the final thermal treatment of the disk substrate, provides solution of the elements zinc and magnesium, and renders the alloy susceptible to strengthening through subsequent age hardening. It is further preferred that the disk be reduced to a substantially stress-free state during this treatment.

In further preferred embodiments, the cooling of the disk substrate following the solution treating associated with the thermal flattening treatment is done in a manner whereby further solution heat treatment is effected. Thus, the flattened disk is held above or in the neighborhood of the $MgZn_2$ solvus temperature for a sufficient period of time to effect solution heat treatment. This is followed by rapid cooling to room temperature to avoid excessive precipitation of $MgZn_2$ precipitate. Best results are generally achieved by maintaining a cooling rate of at least about 0.15° F. (0.08° C.) per second down to a temperature below about 400° F. (204° C.). Faster cooling rates will further enhance the ultimate yield strength of the substrate.

Following the thermal flattening and subsequent cooling steps, the disk substrate is aged, either by natural aging, artificial aging or a combination of the two. Aging is done according to conventional techniques and results in an increase in yield strength to at least about 8 ksi, preferably at least about 14 ksi, and more preferably at least about 20 ksi, due to the formation of hardening-type precipitates. Natural aging is typically done at ambient temperatures over a period of about one to thirty days, whereas artificial aging is generally done for a period of about six to twenty-four hours at temperatures ranging from about 200° F. (93° C.) to about 350° F. (177° C.).

A further advantage of the Al-Zn-Mg alloy of the present invention is that its relatively low magensium level makes it relatively easy to clad by conventional hot rolling techniques. The alloy may thus be used as a high strength core for a cladding which is more controlled against harmful constituent formation. This high level of control in the cladding may either be the result of a low impurity level or some other aspect of its composition or manufacture. Thus clad, the core can tolerate a higher impurity level (particularly in silicon and iron) than if it were used unclad, and homogenization of the core alloy would be much less of a critical need.

The foregoing is intended primarily for purposes of illustration. It will be readily apparent to those skilled in the art that numerous modifications and variations of the procedures and conditions described above may be made without departing from the spirit and scope of the invention.

What is claimed is:

1. A method for preparing a magnetic memory disk substrate, comprising:

(a) forming an aluminum-base alloy containing from about 4% to about 7% zinc and from about 0.6% to about 2% magnesium, in a form substantially free of magnesium silicide;

(b) rolling and cutting said aluminum base alloy into a disk substrate suitable for receiving a magnetizable layer;

(c) heating said disk substrate to reduce stresses introduced in step (b) and to dissolve substantially all zinc and magnesium remaining in undissolved form; and (d) aging the product of step (c) to increase the yield strength thereof to at least about 8 ksi.

2. A method in accordance with claim 1 in which step (a) further includes homogenizing said aluminum-base alloy to dissolve substantially all magnesium silicide present therein.

3. A method in accordance with claim 1 in which step (d) comprises increasing the yield strength of the product of step (c) to at least about 14 ksi.

4. A method in accordance with claim 1 further comprising cooling said disk substrate between steps (c) and (d) at a rate sufficiently rapid while said disk substrate is below the $MgZn_2$ solvus temperature of said aluminum-base alloy to retain the solution heat treatment effected in step (c).

5. A method in accordance with claim 4 further comprising cooling said aluminum-base alloy after said solution heat treatment to a temperature below about 400° F. at a rate of at least about 0.15° F. per second.

6. A method in accordance with claim 1 in which step (c) is performed to the extent whereby said disk substrate is reduced to a substantially stress-free state.

7. A method in accordance with claim 1 in which step (c) is performed at a temperature between about 550° F. and about 900° F.

8. A method in accordance with claim 1 in which step (c) is performed at a temperature between about 650° F. and about 800° F.

9. A method in accordance with claim 1 in which said aluminum-base alloy contains from about 4.5% to about 5.5% zinc and from about 0.9% to about 1.4% magnesium.

10. A method in accordance with claim 1 in which said aluminum-base alloy contains less than about 1% copper, less than about 0.5% manganese, less than about 0.2% zirconium, less than about 0.1% iron, and less than about 0.5% silicon.

11. A method in accordance with claim 1 in which said aluminum-base alloy contains from about 0.01% to about 0.2% silicon.

12. A method for preparing a magnetic memory disk substrate, comprising:

(a) homogenizing an aluminum-base alloy containing from about 4.5% to about 5.5% zinc, from about 0.9% to about 1.4% magnesium, from about 0.01% to about 0.2% silicon, less than about 1% copper, less than about 0.5% manganese, less than about 0.2% zirconium, and less than about 0.1% iron, to dissolve substantially all magnesium silicide present therein;

(b) rolling and cutting the product of step (a) into a disk substrate suitable for receiving a magnetizable layer;

(c) heating said disk substrate to a temperature between about 650° F. and about 800° F. to render said disk substrate substantially stress-free and to dissolve substantially all zinc and magnesium remaining in undissolved form;

(d) cooling said substantially stress-free disk substrate at a rate sufficiently rapid while said disk substrate is below the $MgZn_2$ solvus temperature of said aluminum-base alloy to retain the solution heat treatment effected in step (c); and (e) aging the product of step (d) to increase the yield strength to at least about 14 ksi.

* * * * *